United States Patent [19]

Raisin et al.

[11] Patent Number: 4,714,036

[45] Date of Patent: Dec. 22, 1987

[54] GUIDING DEVICE FOR THE FORMATION OF A FOLD ALONG THE EDGE OF A FABRIC

[75] Inventors: Jean-Pierre Raisin, Troyes; Alain Canaud, Estissac, both of France

[73] Assignee: Institut Textile DeFrance, Boulogne-Billancourt, France

[21] Appl. No.: 39,699

[22] Filed: Apr. 20, 1987

[51] Int. Cl.[4] ..... D05B 35/02; D05B 35/06; D05B 35/10

[52] U.S. Cl. ..... 112/147; 112/152; 112/153; 112/121.27

[58] Field of Search ..... 112/147, 153, 152, 148, 112/121.27, 121.26

[56] References Cited

U.S. PATENT DOCUMENTS

| | | | |
|---|---|---|---|
| 3,752,100 | 8/1973 | Shrep | 112/147 X |
| 3,783,805 | 1/1974 | Guichard | 112/147 X |
| 3,922,978 | 12/1975 | Smith | 112/147 |
| 3,954,071 | 5/1976 | Mall et al. | 112/153 X |
| 3,994,247 | 11/1976 | Cummins | 112/153 X |
| 4,037,547 | 7/1977 | Marjorio | 112/121.27 |
| 4,068,603 | 1/1978 | Arbter | 112/147 X |
| 4,098,204 | 7/1978 | Kojima | 112/147 X |
| 4,159,687 | 7/1979 | Masuda et al. | 112/153 X |

*Primary Examiner*—H. Hampton Hunter
*Attorney, Agent, or Firm*—Arthur B. Colvin

[57] ABSTRACT

The device according to the invention comprises a passive guiding assembly and a correction device, acting in combination to offer a regular fold before the stitching station. The passive assembly comprises two elements of which one is placed inside the other in the form of a U during formation of the fold. The upper and lower faces of the inner element are plane and horizontal, the lower face being in the working plane of the stitching station. The recess between the two elements allows passage of the fabric. The correction device comprises a device for detecting the presence of the fabric placed under the inner element and an active guiding assembly. The active guiding assembly abuts on the fabric and ensures transverse displacement thereof as a function of the instructions given by the detection device.

6 Claims, 9 Drawing Figures

GUIDING DEVICE FOR THE FORMATION OF A FOLD ALONG THE EDGE OF A FABRIC

FIELD OF THE INVENTION

The present invention relates to a device for guiding a supple piece such as a textile piece for the formation of a regular fold along an edge of said piece, this device being placed upstream of a stitching station intended for automatically closing the fold. This invention is applied to the domain of tailoring, for making articles comprising a fold along the edge of the fabric, in particular articles such as tracksuit trousers, shorts, . . . which have an elastic belt obtained by placing an elastic band inside a fold formed along the edge of the fabric.

BACKGROUND OF THE INVENTION

The formation of a fold along an edge of a supple piece such as a textile piece, is generally effected by hand by the operator who folds the piece parallel to the edge over a width corresponding to the desired width of the fold and introduces it, with the fold thus formed, into the stitching station. The fold is more or less regular depending on the operator's skill. A particular difficulty arises when the fold must contain an elastic band, as is the case in tracksuit trousers: the profile that the operator must follow lies beneath the first thickness of fabric and is therefore invisible; the operator must constantly check the width of the fold, by turning the fabric over or by feeling the edges of the elastic and of the fabric.

SUMMARY OF THE INVENTION

A guiding device for forming a regular fold on a supple piece before a stitching station intended for automatically closing the fold, has now been found, and this is the subject matter of the present invention, which overcomes the drawback mentioned above. The device according to the invention comprises, placed in the vicinity of the stitching station and upstream thereof in the direction of displacement of the piece in the course of stitching, a. a passive guiding assembly, consisting of two elements, one being placed inside the other during formation of the fold:

the inner element whose two upper and lower faces are plane and horizontal, the lower face being substantially in the working plane of the stitching station, the outer element having the form of a U and enveloping the inner element on one side and the two horizontal faces, these two elements being positioned with respect to each other so that there exists between said elements a U-shaped recess sufficient to allow passage of the supple piece and effecting formation of the fold, upon passage of the piece in the bent part of said recess, b. a correction device comprising:

a device for detecting the presence of the piece placed, beneath the passive guiding assembly, at a distance approximately equal to the width of the desired fold with respect to the bent part of the recess between the two elements of the passive assembly;

an active guiding assembly consisting of at least one active guide, abutting on the supple piece when it is in contact with one of the faces of the inner element, and ensuring displacement of the piece substantially transversely with respect to the direction of stitching as a function of the instructions given by the detection device.

In this way, the passive assembly, thanks to the shape of the recess formed between the two elements effects formation of the fold itself, and the correction device makes it possible to regulate the width of the fold at the moment of formation thereof. The combined action of the passive assembly and of the correction device has for its effect to present in front of the stitching station a regular fold without any manual intervention by the operator other than the introduction of the piece into the passive assembly.

In the case of application of the device according to the invention to the positioning of an elastic band under the fold formed along the edge of the fabric, the inner element of the passive guiding assembly is a hollow piece having a U-shaped cross section, the plane and horizontal faces constituting the two arms of the U, and the base of the U of the inner element being opposite the base of the U of the outer element. Thanks to this arrangement, the elastic band is inserted in the recess of the inner element, then the fold is formed around the inner element and therefore around the elastic band, and offered to the stitching station.

At least one of the two elements of the passive assembly is transversely retractable. This arrangement facilitates introduction of the elastic band into the recess of the inner element.

The active guiding assembly consists of at least one active guide. In fact, it is most often preferable for it to comprise two active guides, both abutting on the piece when it is in contact with one of the faces of the inner element, but one abutting on the upper face and the other on the lower face. The two guides act so as to ensure in coordinated manner the displacement of the piece as a function of the instructions given by the detection device. The use of two active guides, one acting on the upper part of the fold and the other on the lower part of the fold, is preferable to avoid the accumulation of fabric in the bent part of the recess between the two inner and outer elements of the passive assembly, which accumulation would create mal-functioning of the guiding device.

The outer element preferably comprises at least one opening, opposite one of the horizontal faces of the inner element, through which passes the active guide when it abuts on the supple piece when it is in contact with said face. In this way, the supple piece is held by the elements, at the very spot where the active guide will be applied.

The detection device is preferably a photoelectric detector and the lower part of the outer element comprises an opening allowing passage of the light beam, and the inner element presents a reflecting surface level with said opening.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1A:
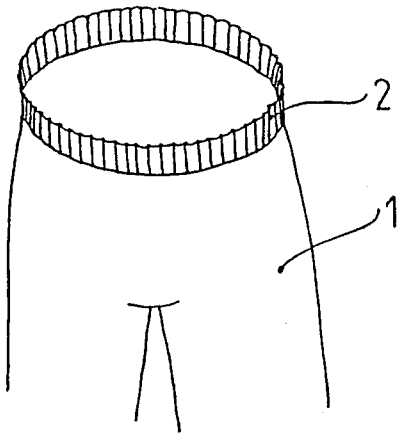
FIGS. 1*a* and 1*b* are illustrations of an elastic band in the form of a bracelet (b) and of an elastic belt of tracksuit trousers (a).
Figure 1B:
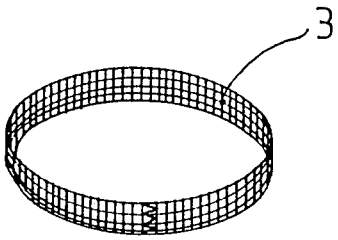
Figure 2:
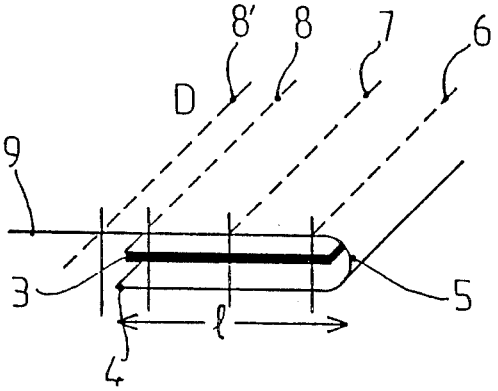
FIG. 2 is a diagram of stitching of the elastic belt.

Referring now to the drawings, articles 1 such as tracksuit or jogging trousers, shorts, . . . have an elastic belt 2 obtained by placing an elastic band 3, generally woven, along the edge of the fabric. This band 3 is previously closed on itself to form a bracelet, as illustrated in FIG. 1*b*. It is then sewn around the tubular belt of article 1, either leaving it visible to prevent the article from sliding on the body, or by hiding it in a fold in the fabric 9. In the latter case, it is necessary to form a fold along the edge of the fabric, to place the elastic band 3 inside the fold and to close the fold in accordance with the diagram of stitching of FIG. 2. The width 1 of the fold, from the edge 4 of the fabric to the folded end 5 of the fold is larger than the width of the elastic band 3 and must be maintained as constant as possible during the stitching operation which comprises for example four lines of stitches: two two-yarn chain stitchings 6, 7 and one two-needle overlap stitching 8, 8' of which the lower yarn 8' hides the edge 4 of the fabric. It is the object of the device of the invention to form a regular fold before the stitching station.

Figure 3:
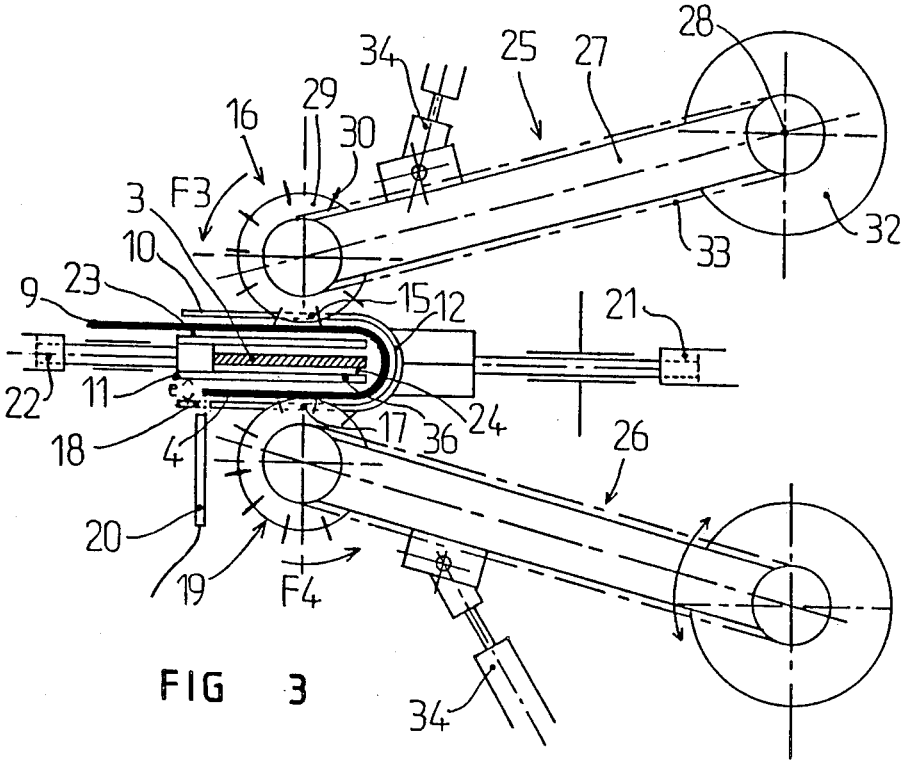
FIG. 3 is a schematic view in section of the guiding device of the invention.
Figure 4A:
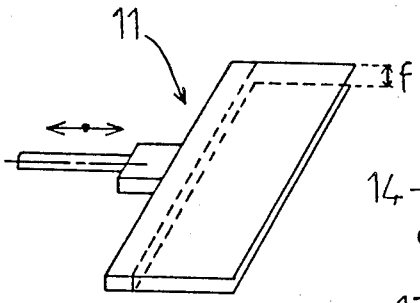
FIGS. 4*a* and 4*b* are schematic views in perspective of the inner element (a) and outer element (b) of the passive assembly.
Figure 4B:
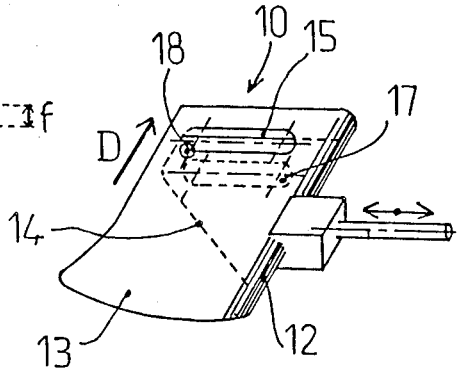
Figure 5:
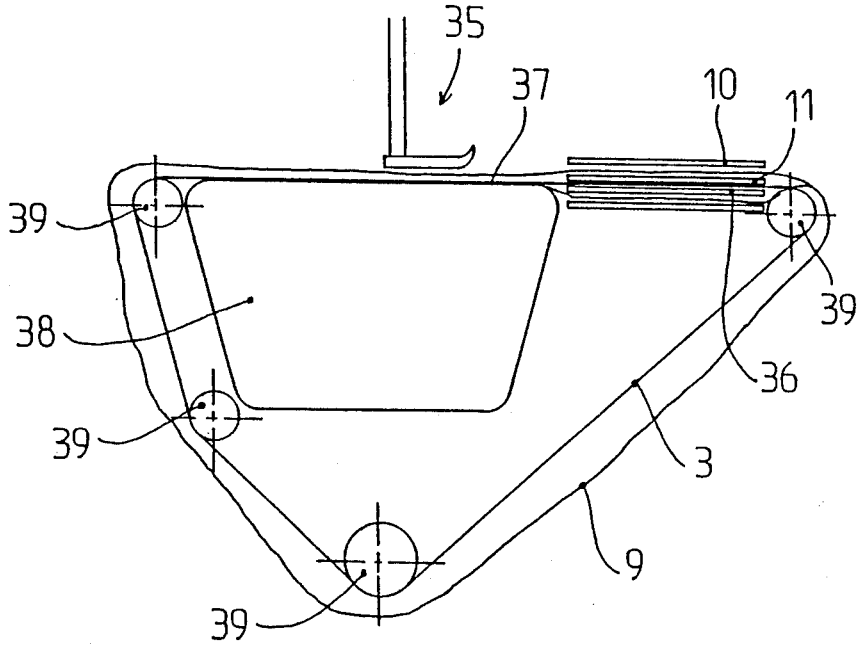
FIG. 5 is a schematic view in section of the stitching station.

The guiding device (FIG. 3) comprises two parts, one for forming the fold and the other for transverse guiding of the fabric. The part corresponding to the formation of the fold comprises two pieces 10 and 11, both in U form, of which one, 11, is placed inside the other, 10. The outer piece 10 presents a bent part 12 which is the base of the U; this piece 10 is retractable transversely with respect to the direction D of stitching thanks to the action of jack 21. The front part 13—in the direction D of displacement of the fabric during stitching—of the upper arm of this piece 10 widens upwardly to facilitate introduction of the fabric 9, the front part 14 of the lower arm of this piece 10 is oblique with respect to the direction D of stitching (FIG. 4*b*). The upper arm of this same piece 10 is pierced with an opening 15 for passage of the head 16 of the upper active guide and the lower arm is pierced with two openings 17 and 18, one, 17, for the passage of the head 19 of the lower active guide, and the other, 18, for the passage of the light beam coming from the photo-electric detector 20. The inner piece 11 is retractable transversely with respect to the direction D of stitching, thanks to the action of the jack 22, in the opposite direction to piece 10, as will be explained hereinafter. The open end of the U formed by the piece 11 is opposite the bent inner part 12 of the piece 10. The recess 23 formed between the two pieces 10 and 11, when the piece 11 is inside piece 10 in position of formation of the fold, has a cross section in the form of a U and a height e sufficient to allow passage of the fabric 9. The recess 24 inside piece 11 has a parallelepipedic cross section and a height f sufficient to allow passage of the elastic band 3. The heights e and f must be largely greater than the normal thickness of the fabric (for e) and of the elastic band (for f) to allow passage of the excess thicknesses due to the closure of these two elements on themselves.

Figure 7:
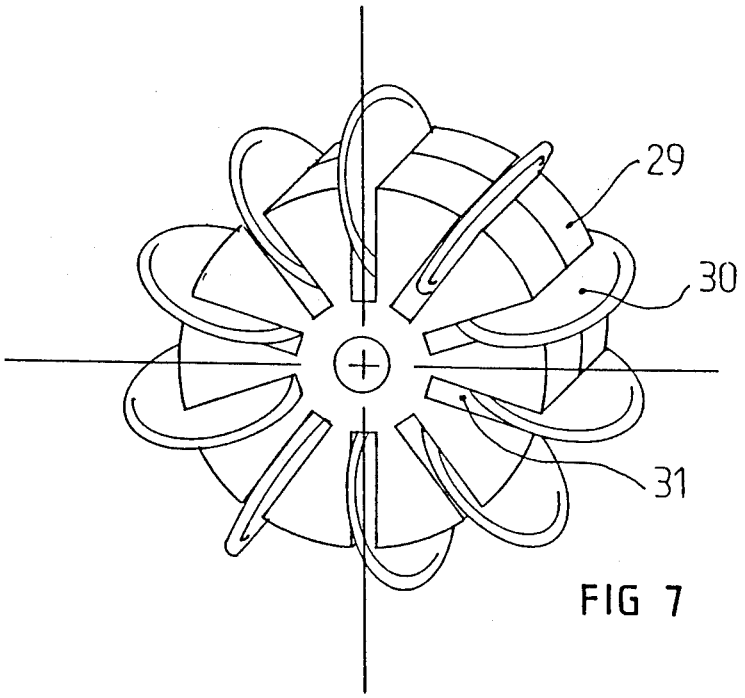
FIG. 7 is a schematic view in perspective of a guiding head.

That part of the device of the invention corresponding to transverse guiding of the fabric during formation of the fold comprises two active guides 25 and 26 and the detection device 20. The two guides 25 and 26 are identical, one, 25, acting on the upper part of the fold, the other, 26, on the lower part of the fold. Each of these active guides is constituted by a guiding head 16, fixed to the end of an arm 27 which is articulated about a shaft 28. The guiding head 16 comprises a roller 29, mobile in rotation, provided on its periphery with ten discs 30, free to rotate in recesses 31 made radially in the roller 29 (FIG. 7). The roller 29 is driven in rotation by the step-by-step motor 32 by means of the belt 33. The pneumatic jack 34 makes it possible—in low position—to apply the guiding head 16 against the upper face of the piece 11 with a pressure controlled by a pressure-gauge/-reducing valve (not shown), the guiding head passing through the opening 15 made in the upper arm of the piece 10. With jack 34 in high position, the stitching head is remote from piece 10.

The detection device 10 consists of a photoelectric cell which sends a light beam which is reflected on the lower face of the piece 11. When the cell 20 detects the presence of the fabric 9 when the latter cuts the light beam, or its absence, it controls the action of the step-by-step motor 32 in one direction or in the other.

The assembly of the guiding device according to the invention is placed in front of the stitching head 35 so that the face 36 of the piece 10 is substantially in the same plane as the upper part 37 of the arm 38 of the sewing machine. Furthemore, four rollers 39 are disposed around the arm 38 of the sewing machine to receive the elastic band 3 in the form of a bracelet, the two upper rollers 39 being disposed so that the elastic band 3 rests on the upper part 37 of the arm 38.

Figure 6:
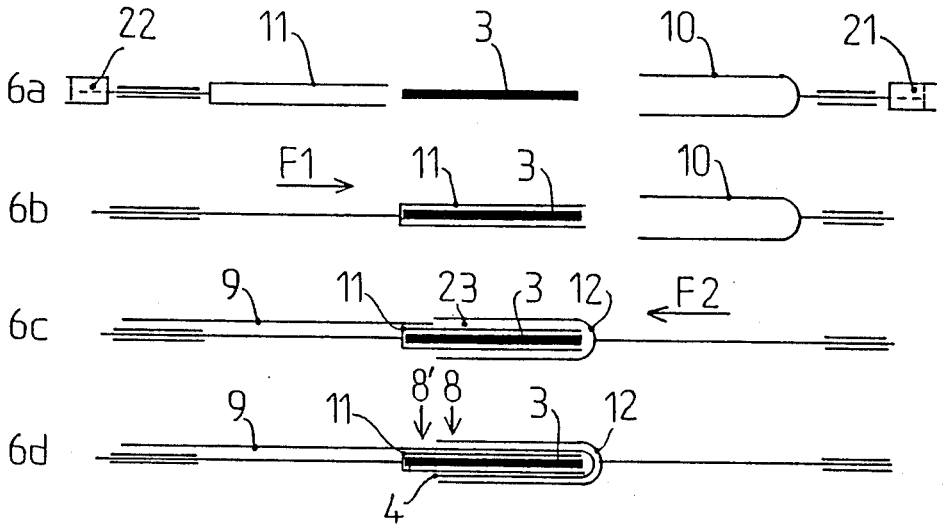
FIGS. 6*a* to 6*b* show the different phases of introduction of the elastic band and of formation of the fold.

The device operates as follows: During the phases of introduction of the elastic band 3, on the one hand, the guiding heads 16 and 19 are moved away from each other, the jacks 34 being in high position, and on the other hand, the pieces 10 and 11 are moved away from each other under the action of jacks 21 and 22 (FIG. 6*a*). The operator positions the elastic band 3 around the rollers 39, the presser-foot of the stitching head 35 being raised. Once the band is positioned, the piece 11 is moved under the action of the jack 22 in the direction of arrow F1 (FIG. 6*b*) so that the band 3 passes between the two U-arms of piece 11. The piece 10 is then advanced under the action of the jack 21 in the direction of arrow F2 (FIG. 6*c*) so as to envelop the U-arms of piece 11. The fabric 9 is introduced manually by the operator in the upper part of the recess 23 formed between the two pieces 10 and 11 until the fold is formed by sliding the fabric 9 on the different surfaces of the two pieces 10 and 11 forming the recess 23 and in particular the bent part 12 of the piece 10 (FIG. 6*d*). The fabric 9 is pushed by the operator in direction D of stitching so that the oblique edge 14 of the lower arm of the piece 10 facilitates the formation of the fold. The guiding heads 16 and 19 are applied on the upper and lower arms, respectively, of the piece 11, under the action of the corresponding jacks 34, in low position. Consequently, the guiding heads 16 and 19 grip the fabric 9 against the two faces of the piece 11.

When the photo-electric cell 20 is uncovered, i.e. when the fabric 9 does not cut off the light beam level with opening 18, the signal emitted by the cell controls, via known electronic processing means, the rotation of the roller 29 of the head 16 in the direction of arrow F 3 (FIG. 3) and that of the roller 29 of the head 19 in the direction of arrow F4 until the edge 4 of the fabric 9 covers the cell 20. When the latter is covered, a contrary signal controls rotation of the rollers 29 in the opposite direction. The two rollers therefore have simultaneous and complementary actions to position the edge 4 of the fabric 9 with respect to the stitching lines 8 and 8' during the sewing operation.

When the beginning of the assembly returns to the inlet of pieces 10 and 11, the latter are retracted under the action of jacks 21 and 22 in the direction opposite arrows F1 and F2, and the rollers 29 are moved away under the action of the jacks 34 for the operator to be able to finish sewing and evacuate the article 1.

In the embodiment described hereinabove, the length of the arms of U-shaped piece 10 is 40 mm, that of the arms of piece 11 is 25 mm; the inner recess e between the two pieces 10 and 11 is 3.5 mm; the outer diameter of the guiding heads 16 and 19 is 30 mm; the inner recess f between the two arms of piece 11 is 3 mm; the distance between the inner bent part 12 of the piece 10 and the end of the arms of the piece 11 is 10 mm. The rear part of the piece 10—in the direction D of displacement of the fabric during stitching—is 60 mm from the needles.

The example described hereinabove has been given by way of illustration and does not limit the invention. Other types of active guide may be used, such as the one described in French patent No. 2518134, i.e. a guiding wheel whose axis of rotation is parallel to the direction D of stitching and applied to the fabric 9 with a modulatable pressure. Two photoelectric cells may be used, defining a zone inside which the active guides 25 and 26 no longer act and corresponding to the tolerance of regularity of the width 1 of the fold.

What is claimed is:

1. A guiding device for forming a regular fold on a supple piece before a stitching station intended for automatically closing the fold, wherein it comprises, placed in the vicinity of the stitching station and upstream thereof in the direction D of displacement of the piece in the course of stitching, a. a passive guiding assembly, consisting of two elements, one being placed inside the other during formation of the fold:

the inner element whose two upper and lower faces are plane and horizontal, the lower face being substantially in the working plane of the stitching station, the outer element having the form of a U and enveloping the inner element on one side and the two horizontal faces, these two elements being positioned with respect to each other so that there exists between said elements a U-shaped recess sufficient to allow passage of the supple piece and effecting formation of the fold, upon passage of the piece in the bent part of said recess, b. a correction device comprising:

a device for detecting the presence of the piece placed, beneath the passive guiding assembly, at a distance approximately equal to the width of the desired fold with respect to the bent part of the recess between the two elements of the passive assembly;

an active guiding assembly consisting of at least one active guide, abutting on the supple piece when it is in contact with one of the faces of the inner element, and ensuring displacement of the piece substantially transversely with respect to the direction D of stitching as a function of the instructions given by the detection device.

2. The device of claim 1, wherein the active guiding assembly comprises two active guides, one applied on the upper face of the inner element and the other on the lower face of said element, of which the actions are simultaneous and in the same direction with respect to the fabric.

3. The device of one of claim 1, wherein the outer element comprises at least one opening for the passage of the corresponding active guide.

4. The device of claim 1, wherein the lower face of the outer element comprises at least one opening, and the detection device consists of a photo-electric cell placed level with said opening opposite a reflecting surface of the lower face of the inner element.

5. The guiding device for forming a regular fold surrounding a band, particularly an elastic band, of claim 1, wherein the inner element of the passive assembly is a hollow piece having a U-shaped cross section, the two arms of the U being constituted by the plane, horizontal faces of said element and being opposite the inner bent part of the outer element.

6. The device of claim 1, wherein the inner and outer elements are transversely retractable.

* * * * *